US005277679A

United States Patent [19]

Wells

[11] Patent Number: 5,277,679

[45] Date of Patent: Jan. 11, 1994

[54] MARTIAL ARTS PRACTICE APPARATUS WITH AUTOMATIC RETURN

[76] Inventor: Ray L. Wells, 1658 W. Kentucky Ave., Denver, Colo. 80223

[21] Appl. No.: 855,210

[22] Filed: Mar. 20, 1992

[51] Int. Cl.[5] ..... A63B 69/34

[52] U.S. Cl. ..... 482/83; 482/87; 482/90

[58] Field of Search ..... 482/89, 87, 83, 90, 482/148, 84-86; 275/55 R

[56] References Cited

U.S. PATENT DOCUMENTS

| | | | |
|---|---|---|---|
| 1,679,174 | 7/1928 | Richards et al. | 482/83 |
| 3,250,533 | 5/1966 | Nicholson, II | 482/83 |
| 4,093,212 | 6/1978 | Jacques | 482/83 |
| 4,309,029 | 1/1982 | Tomko | 272/76 |
| 4,491,316 | 1/1985 | Prince | 272/78 |
| 4,564,192 | 1/1986 | Lebowitz | 272/76 |
| 4,635,929 | 1/1987 | Shustack | 272/76 |
| 4,662,630 | 5/1987 | Dignard et al. | 272/76 |
| 4,749,184 | 6/1988 | Tobin | 272/76 |
| 4,807,871 | 2/1989 | Bryson | 272/76 |
| 4,836,533 | 6/1989 | Dong | 272/76 |
| 4,913,419 | 4/1990 | McAuliffe | 272/76 |
| 4,932,652 | 6/1990 | Beal, III | 272/76 |
| 4,964,629 | 10/1990 | Wright | 272/76 |

FOREIGN PATENT DOCUMENTS

| | | | |
|---|---|---|---|
| 3203044 | 11/1982 | Fed. Rep. of Germany | 482/90 |
| 5275 | 3/1894 | Switzerland | 482/83 |

*Primary Examiner*—Stephen R. Crow
*Assistant Examiner*—Jerome Donnelly
*Attorney, Agent, or Firm*—John E. Reilly

[57] ABSTRACT

Karate practice apparatus includes a target pad mounted on a horizontally extending arm, the arm being adjustably mounted on a vertical shaft which is anchored at its lower end in a base housing, and a resistance system in the base housing yieldingly resists rotation of the shaft when the target is truck from either side either by kicking or punching so as to return the target pad to its neutral position. The target pad is composed of a high density foam material which is molded around the support arm and is readily interchangeable so as to conform to the level of skill of the athlete.

16 Claims, 2 Drawing Sheets

MARTIAL ARTS PRACTICE APPARATUS WITH AUTOMATIC RETURN

This invention relates to athletic exercise equipment and more particularly relates to a novel and improved martial arts training and practice apparatus for perfecting one's skills in the art of kicking or punching a target.

BACKGROUND AND FIELD OF INVENTION

In the field of martial arts, numerous training devices have been devised for the purpose of developing accuracy and speed in punching and kicking. In this field, it is desirable to build strength in one's arms and legs in very much the same manner as a body builder develops different sets of muscles by lifting weights. In developing punching and kicking skills, the aim is to improve timing, focus, balance and speed in striking a target with a given force while avoiding the necessity of having another person hold the target and minimizing the risk of injury.

In the past, devices have been employed which accomplish a number of the enumerated aims or objectives. For example, U.S. Pat. No. 4,749,184 to Tobin employs a target at the end of a padded sleeve with an elastic strap to encircle the target; and a free-standing support frame is provided with spaced-apart upstanding stationary portions in a generally triangular arrangement, the target being pivotally mounted to one of the portions with spring resistance members extending to and supported by the other portions to yieldingly resist pivotal movement of the target.

U.S. Pat. No. 4,491,316 to Prince also discloses a padded target which is free to swivel or rotate through a limited angle and includes a cushioned pad with an outer fabric cover and tubular support member which fits over an arm support for the target. Another form of padded target is disclosed in U.S. Pat. No. 4,913,419 to McAuliffe and which comprises a polypropylene board with a resilient mounting portion.

U.S. Pat. No. 4,662,630 to Dignard et al. discloses another type of striking board, and U.S Pat. No. 4,564,192 to Lebowitz discloses a target which includes a cushioned or padded portion surrounding a support arm. Other representative patents in this field are those to Tomko, No. 4,309,029; Schustack, No. 4,635,929; Bryson, No. 4,807,871; Dong, No. 4,836,533; Beall, No. 4,932,652; and Wright, No. 4,964,629.

Nevertheless, there is a particular need for a martial arts training and practice device incorporating a novel and improved target pad of improved configuration and which is so mounted and arranged as to be readily conformable to the skill of the user; also to provide a novel and improved return mechanism for the target pad which is completely hidden in a base of the apparatus so as to increase the stability of the apparatus and substantially reduce the number of exposed moving parts.

SUMMARY OF THE INVENTION

It is an object of the present invention to provide for a novel and improved martial arts practice apparatus which is adaptable for use in practicing different kicking or punching combinations.

Another object of the present invention is to provide in a martial arts training apparatus for a novel and improved target pad which is durable, comprised of a minimum number of parts and which is detachable and interchangeable so as to best suit the needs of the user; and further wherein the target pad can be adjusted to the level of skill of the student.

A further object of the present invention is to provide a martial arts practice apparatus which is readily adaptable for mounting on different floor or base surfaces, and can be stabilized without permanent attachment into the floor or base.

It is a still further object of the present invention to provide for a novel and improved martial arts training apparatus which contains a minimum number of moving parts and, in particular, a minimum number of exposed moving parts so as to minimize any risk of injury.

It is an additional object of the present invention to provide a martial arts practice apparatus which is highly versatile and is conformable for use in practicing different hand-punching or foot-kicking exercises; and wherein the target pad is so mounted as to be capable of undergoing limited rotation in response to an applied force, such as, delivered by a punch or kick while imparting a predetermined resistance to the application of such force and be automatically returned to its original position with a minimum of oscillation or vibration and which will enable the user to deliver repetitive blows without interference.

In accordance with the present invention there has been devised for a martial arts training and practice apparatus an improved form of target member and support and wherein the apparatus includes a base and upright mast mounted on the base, the improved form of target member including a horizontally extending support arm, a pad disposed in surrounding relation to a free end of said support arm which includes a generally rectangular block at the end of the support arm, the support arm having a greater length extending through a substantial length of the pad, rotational support means are provided for the target member, the support means being journaled for rotation with respect to the mast and including means for vertically adjusting the target member with respect to the mast, and resistance means on the base for yieldingly resisting rotational movement of said target member.

Preferably, the pad on the target member is composed of a high-density foam material which is molded into surrounding relation to the support arm and has an oversized block at the free end of the support arm so as to cushion any blows delivered. The resistance means is preferably located within a base housing and is characterized in particular by its ability to yieldingly resist rotational movement of the target and to cause automatic return of the target member to its original or neutral position after the blow has been delivered and in such a way as to minimize any oscillation or vibrations of the target member when it returns to its neutral position.

The above and other objects of the present invention will become more readily appreciated and understood from a consideration of the following detailed description of a preferred embodiment when taken together with the accompanying drawings wherein:

DETAILED DESCRIPTION OF THE PREFERRED EMBODIMENT

Figure 2:
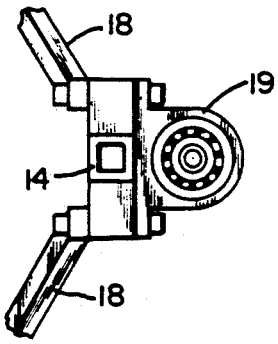
FIG. 2 is an upper end view taken about 2—2 of FIG. 1.
Figure 1:
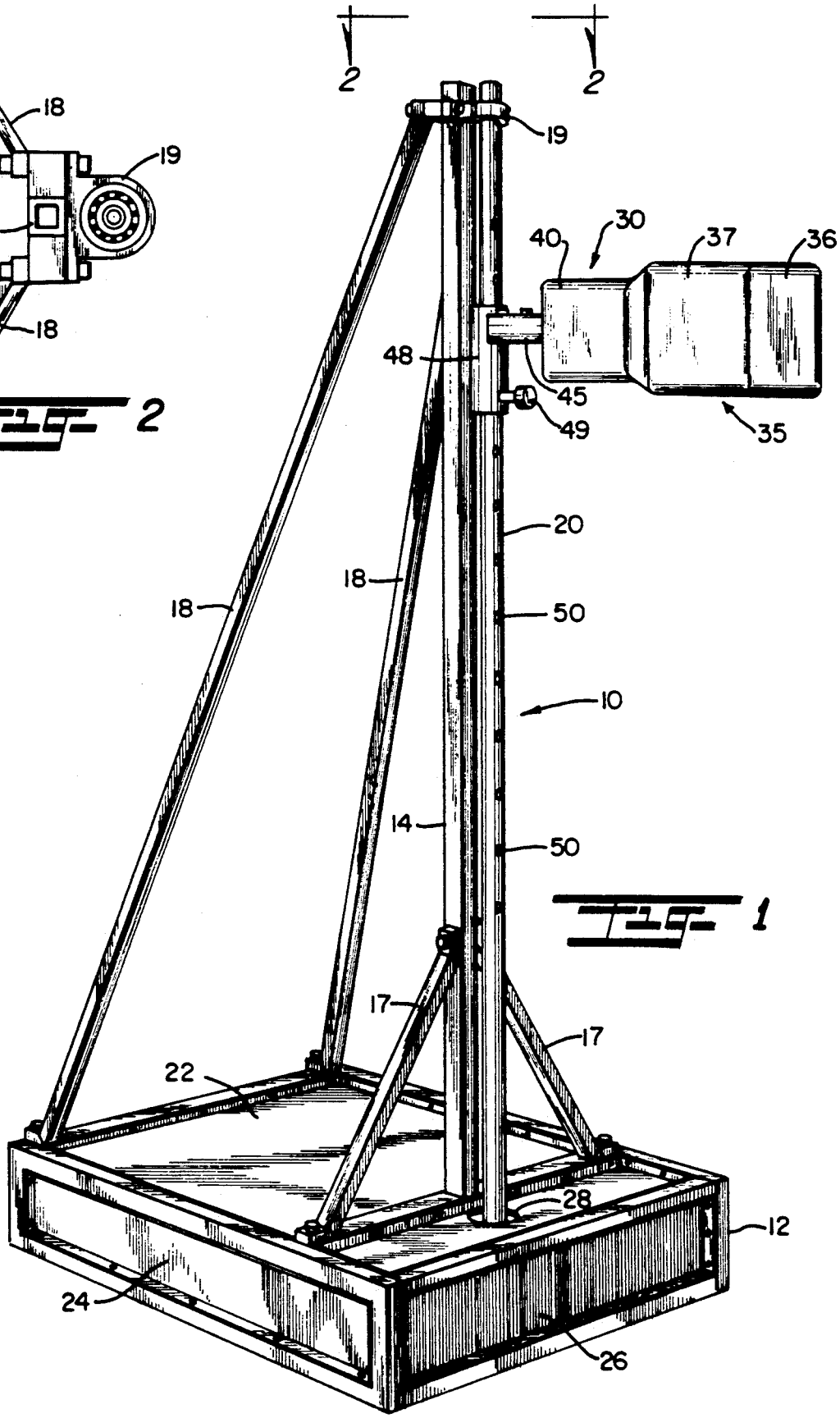
FIG. 1 is a perspective view of a preferred form of practice apparatus in accordance with the present invention.
Figure 3:
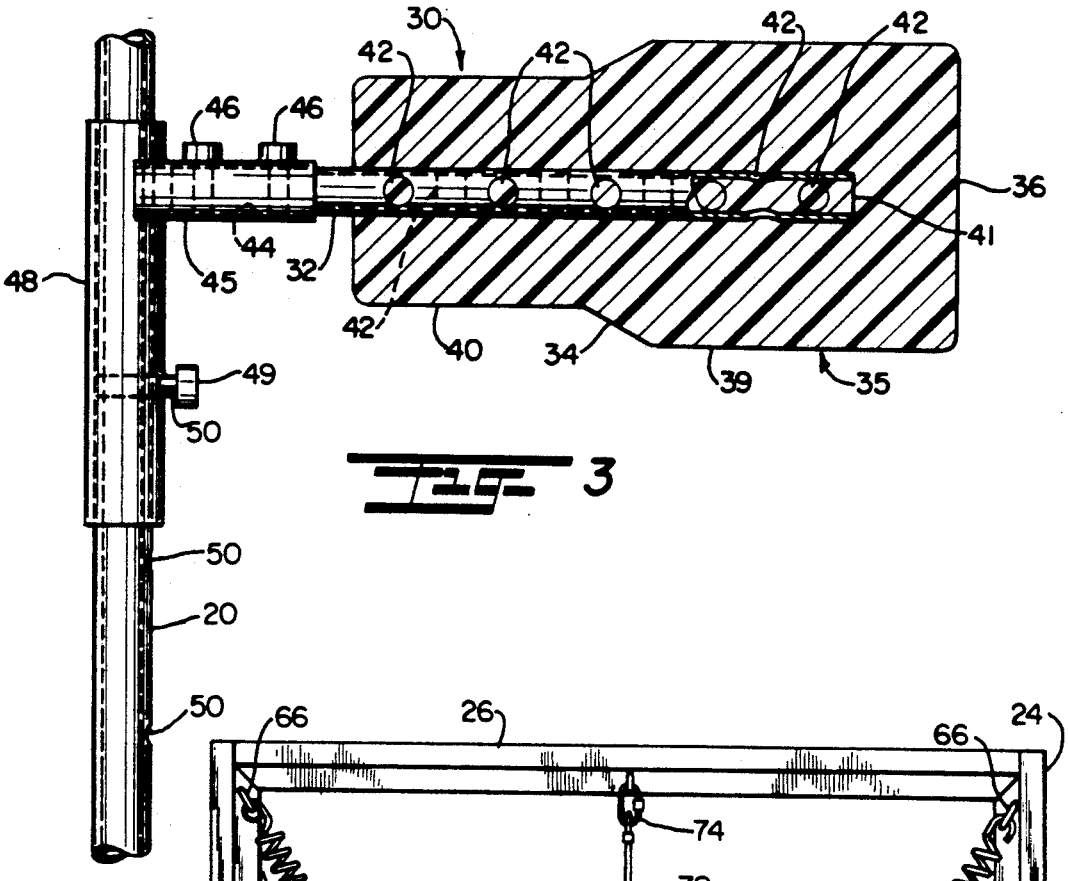
FIG. 3 is an enlarged view partially in section of the target member of the preferred form of invention.
Figure 4:
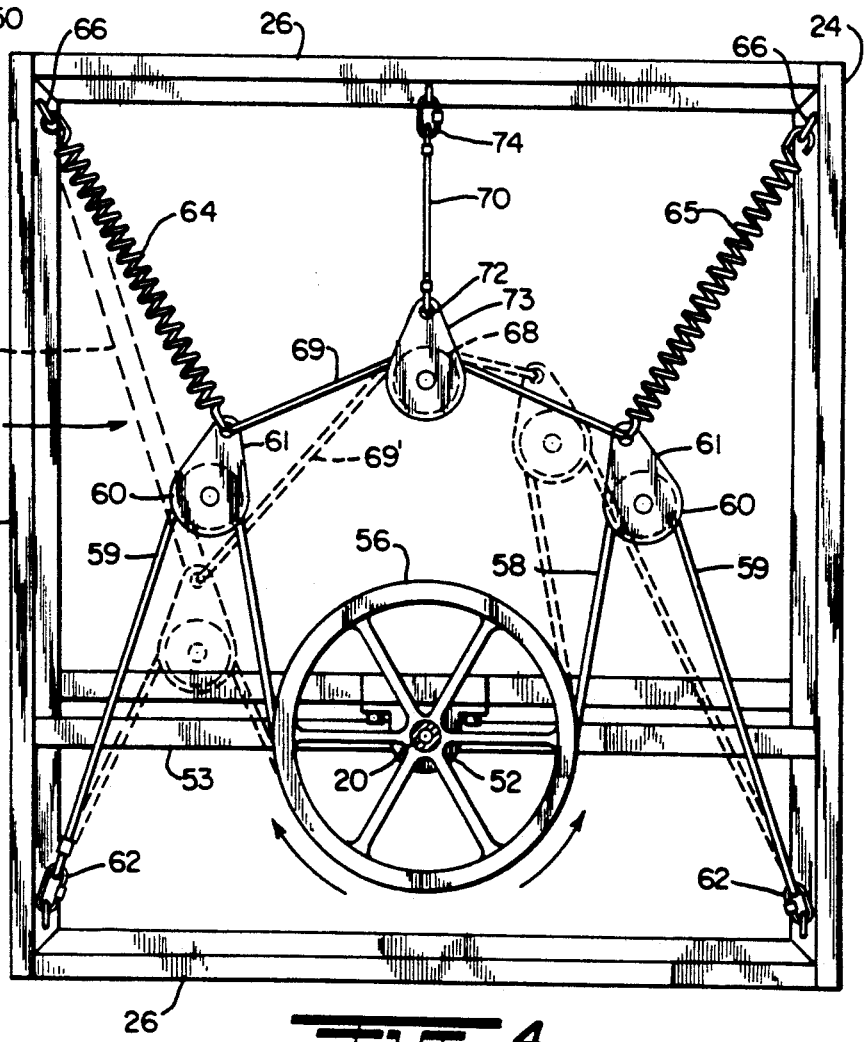
FIG. 4 is a cross sectional view taken through the base housing of the preferred form of invention.

Referring in more detail to the drawings, there is illustrated in FIGS. 1–4 a preferred form of practice apparatus 10 which is comprised of a base 12, and a stand has an upright mast 14 extending upwardly from the base, the lower end of the mast centered on a horizontal brace 16 on top of the base 12. Side braces 17 are attached at their lower ends to the horizontal brace 16 and incline upwardly and inwardly for attachment to opposite sides of the mast 14, and rear angular braces 18 extend upwardly from rear corners of the base 12 for attachment to a bearing 19 at the upper end of the mast 14. A torsion shaft 20 is disposed in spaced parallel relation to the front surface of the mast 14 and has its upper end journaled in the bearing member 19, the lower end of the torsion shaft being journaled within the base 12 in a manner to be described, and the torsion shaft serves as the rotational support for a target member 30 to be hereinafter described. The mast 14 and braces 17 and 18 are illustrated as being of square cross-section but may be of circular cross-section also.

Preferably, the base 12 is in the form of a shallow rectangular housing having a top surface 22, side panels 24, end panels 26 and a hole 28 in the top surface 22 for insertion of the torsion shaft 20.

Referring in more detail to the target member 30, it is comprised of a horizontal support arm 32 and a target pad 34 which includes an elongated generally rectangular block 35 having a flat end surface 36 and opposite vertical sides 37 with top and bottom surfaces 38 and 39. The block 35 tapers rearwardly into a smaller, hollow sleeve-like end portion 40 with the support arm 32 extending horizontally through the hollow interior of the sleeve-like portion 40 and of the block 35. In assembled relation, the support arm has its greater length extending through the sleeve portion 40 and block 35 to terminate at its free end 41 just short of the end surface 36. The support arm 32 has a series of spaced openings 42, and the pad is preferably composed of a high density foam material which is molded in surrounding relation to the support arm as well as to pass through the openings 42 in the arm so that the pad 34 is molded or cured into unitary relation to the support arm 32. A preferred form of high-density foam material is a mixture of WUC28080 resin/WUC3092T isocyanate sold by BASF Corp. located at Wyandotte, Mich., and which material has a molded density on the order of 10 to 30 pcf. The support arm 32 also includes an exposed end 44 which is inserted into the horizontal sleeve member 45 and locked into position by locking screws 46. The sleeve member 45 extends radially in a horizontal direction from a vertical adjustment sleeve member 48 which is disposed in surrounding relation to the torsion shaft and adjustably attached at the desired height to the shaft 20 by means of a locking screw 49 which can be aligned with and inserted into one of a series of vertically spaced adjustment holes 50 along the front surface of the torsion shaft 20.

The lower end of the shaft 20 extends downwardly through the hole 28 in the base housing and is journaled in a bearing 52 which is mounted on a cross brace 53 within the housing.

The target member 30 is positioned at a level which will be selected by the athlete or user to best perform a given exercise, such as, to carry out punching or kicking drills with the hands or feet. In martial arts, to perform these drills, the opposite side surfaces 37 define the target surfaces and are intended to receive a blow directed at the target member which will cause the target member 30 to rotate the torsion shaft 20 about its vertical axis. In this relation, it is important to offer a selected amount of inertial resistance to such rotation so that, after the blow is delivered, the target member 30 will be automatically returned to its original or neutral position with little or no oscillation or vibration. In other words, the target member 30 should return to a stationary position within a minimum of time in preparation for the next blow to be delivered. To this end, yieldable resistance means 54 is enclosed within the base 12 and comprises a large horizontally disposed pulley wheel 56 which is fixed for rotation to the lower end of the shaft 20, and a cable 58 is attached or otherwise locked to the forward end of the pulley 56 and has opposite ends 59 trained over auxiliary pulleys 60, the opposite ends 59 having their terminal or free ends anchored at 62 to front corners of the base 12. The yieldable resistance means 54 also includes resilient bias members defined by spring members 64 and 65 which are mounted under compression to extend between rear corners 66 of the base 12 for attachment to pulley block 61 for the auxiliary pulley members 60. Generally, the diagonal extension of the spring members 64 is on imaginary lines intersecting one another at the vertical axis of the torsion shaft so as to exert tension on the cable member 58 and increase the frictional engagement of the cable 58 with the grooved surface of the pulley wheel 56 as well as to equally but yieldingly resist any rotational movement of the torsion shaft 20. A side blow delivered to either side surface 37 of the target pad 34 will cause an unbalanced resistance or, in other words, will overcome the resistance of one of the spring members to cause rotation of the pulley wheel 56 and cable 58. For example, when a force is applied in a counterclockwise direction, the pulley wheel 56 will be rotated in the same direction causing the spring member 64 to be stretched from the position illustrated in full in FIG. 4 to the dotted line position as designated at 64'. Simultaneously, the spring member 65 will contract somewhat and be simultaneously drawn from the full-line position to the dotted-line position of FIG. 4. After the blow has been delivered, the increased tension of the spring member 64 with respect to spring member 65 will cause the pulleys to immediately return to their original full-line positions and with the pulley wheel 56 returning the target pad 34 to its original neutral position in preparation for the next blow to be delivered.

In order to minimize any tendency of the spring members 64 and 65 to oscillate or vibrate the target pad 34 in returning to the neutral position, a highly effective form of dampener has been found to be the utilization of an intermediate pulley 68 for a cable member 69 extending between the attachment points of the spring members 64 and 65 to the pulley blocks 61, and an anchor cable 70 has one end fixed as at 72 to pulley block 73 for the pulley 68 and an opposite end 74 attached to the rearward end wall of the base housing. The length of the anchor cable 70 is such as to introduce some tension into the cable member 69 toward the rear end of the base member and create enough frictional resistance with the cable member 69 to counteract any tendency of the spring members 64 and 65 to oscillate, once the resistance has been equalized on the opposite ends of the main cable 58.

It should also be noted that the intermediate cable 70 is adjustable at one end 74 in order to permit the tension to be regulated as required for corrective action of the target member and particularly to control the speed of return of the target and to dampen the oscillation of the target pad when it returns to center. A similar adjustment can be made at the ends 62 of the cable 58.

The apparatus 10 as described can be positioned on various floor or ground surfaces and either temporarily or permanently anchored in place. Although not shown, adjustable feet are provided at the bottom corners of the base which in a conventional and well-known manner permit leveling of the apparatus. If the apparatus is to be temporarily anchored, the machine may be weighted down by suitable weights, such as, sand bags or can be more permanently mounted by inserting bolts downwardly through the base 12 and into the floor surface. There are numerous advantages associated with the positioning of the resistance mechanism within the base. As discussed earlier, the mechanism is not exposed to outside elements and, if a cable or spring should fail or break will not injure the user or any bystanders. Furthermore, a substantial part of the weight of the mechanism will be in the base so as to increase its stability.

In use, the target member 30 and specifically the pad 34 will rotate in a horizontal direction when struck on either side face 37 and is free to rotate through an angle of approximately 90° to 120° either to the left or right. The resistance mechanism will cause automatic return of the target pad 35 to its neutral position with little or no oscillation. The target pad 35 is detachable and interchangeable with different length and size target members according to the level of skill of the user and the amount of force to be applied. For example, a longer target member 30 is slower due to the increased centrifugal force that is required, allowing beginners to use a slower action and giving them time to adjust and not to rush their technique. Advanced students will generally prefer a target with a shorter travel thus to practice at full speed and develop timing, focus, speed, power and balance as well as an overall sense of confidence in their technique. Typically, the target area as presented by the side faces 37 would be on the order of eight inches by eight inches although the target area and configuration may be suitably varied.

The target pad is so constructed and designed as to permit substitution of different lengths and size targets according to the skill of the user. In this connection, the two-piece construction of the target member consisting of the support arm 32 and pad 34 permits low cost substitution of different selected targets. Moreover, the construction of the pad out of the high-density foam provides a soft target which will nevertheless permit the athlete to wear shoes when exercising without damaging the pad itself. For the purpose of illustration and not limitation, a typical pad is on the order of 16 inches long with a crossectional size of 8 inches by 6 inches; and the length of the support arm 32 is on the order of 20 inches and having an exposed length of approximately 6 inches. Typically, the front face of the target would project beyond the free end of the arm for a distance of at least 2 inches.

It is therefore to be understood that while a preferred form of practice apparatus is herein set forth and described, various modifications and changes may be made therein without departing from the spirit and scope of the present invention as defined by the appended claims and reasonable equivalents thereof.

I claim:

1. In an athletic practice apparatus adapted for use by an athlete to deliver blows with the hand or foot, said apparatus including a base, and an upright mast mounted on said base, the improvement comprising:

a target member including a horizontally extending support arm, a pad disposed in surrounding relation to a free end of said support arm, said pad being of generally rectangular configuration and elongated in a horizontal direction, said support arm having a greater length extending through a substantial length of said pad, said pad including an end surface disposed beyond a free end of said support arm and opposed sides of said pad defining striking surfaces;

elongated rotational support means for said target member, said support means extending upwardly from said base and journaled with respect to said mast for rotation about a vertical axis, said target member mounted on said support means at a location spaced above said base, said support means including means for vertically adjusting said target member with respect to said mast; and resistance means on said base being engageable with said support means for yieldingly resisting rotational movement of said target member.

2. In practice apparatus according to claim 1, including angular brace members extending between said mast and said base.

3. In practice apparatus according to claim 1, said resistance means including an enlarged pulley fixed for rotation at a lower end of said support means, a cable trained over said pulley, said cable having opposite ends extending away from said pulley, and resilient means engagable with said opposite ends of said cable to exert a predetermined degree of tension on said cable urging said cable into frictional engagement with said pulley thereby resisting rotation of said pulley in response to rotational movement of said target member about said support means.

4. In practice apparatus according to claim 3, including an auxiliary pulley member interposed between each of said opposite ends of said cable and said resilient means.

5. In practice apparatus according to claim 4, including dampener means between said auxiliary pulley members and said resilient means for dampening any vibration of said resilient means.

6. In a martial arts practice apparatus adapted for use by an athlete to deliver blows with the hand or foot, said apparatus including a base, and an upright mast mounted on said base, the improvement comprising:

a target member including a horizontally extending support arm, a pad disposed in surrounding relation to a free end of said support arm, said pad elongated in a horizontal direction and including a generally rectangular block, said support arm extending through a substantial length of said pad, said block including a flat vertical end surface disposed beyond a free end of said support arm and opposed flat vertical sides of said block defining striking surfaces;

said mast including elongated rotational support means mounted on said base for rotation about a vertical axis, said target member mounted on said support means at a location spaced above said base, said support means including means for vertically adjusting said target member with respect to sad mast; and said base having an outer housing, and resistance means in said housing being engageable with said support means for yielding resisting rotational movement of said target member.

7. In a practice apparatus according to claim 6, said block being composed of a high density foam material.

8. In a practice apparatus according to claim 6, said resistance means including a pulley wheel fixed for rotation to a lower end of said support means, an inelastic cable trained over said pulley wheel, said cable having opposite ends extending away from said pulley, and resilient means engagable with said opposite ends of said cable to exert tension on said cable in a direction urging said cable into frictional engagement with said pulley wheel thereby resisting rotation of said pulley wheel in response to rotational movement of said target member about said support means.

9. In apparatus according to claim 8, including an auxiliary pulley member interposed between each of said opposite ends of said cable and said resilient means, and dampener means between said auxiliary pulley members and said resilient means.

10. In martial arts practice apparatus wherein a stand is provided with an upright rotational support member, and a target member is mounted on said rotational support member for horizontal extension therefrom, said target member comprised of a support arm and a target pad in outer surrounding relation to said support arm, the method of manufacturing said target member comprising the steps of positioning said support arm in centered relation to said mold, said mold having a hollow interior conforming to the configuration of said target pad and said support arm having a greater length extending into said hollow interior of said mold, and injecting a high-density plastic foam material into said mold whereby to fill said hollow interior of said mold, and followed by curing said high-density foam material around said support arm.

11. In apparatus according to claim 10, said high-density foam material having a density in the range of 10 to 30 pcf.

12. In apparatus according to claim 10, said support arm provided with openings at spaced intervals in a lengthwise direction of said support arms, and said high-density foam material filling said openings in said support arm.

13. Karate exercise apparatus comprising:

a base housing;

an upright stand including a torsion shaft extending upwardly from said base housing and means for supporting said torsion shaft in journaled relation to said stand;

a vertically adjustable target member mounted on said torsion shaft including a horizontally extending support arm and a target pad mounted on said support arm including target surfaces on opposite sides of said target pad, said torsion shaft being rotatable from a neutral position in response to a blow delivered to one of said target surfaces; and resistance means in said base housing being engageable with said torsion shaft for yieldingly resisting rotation of said torsion shaft and for returning said torsion shaft to said neutral position after a blow has been delivered, said resistance means including a pulley wheel fixed for rotation on said torsion shaft, a non-elastic cable trained over said pulley wheel, and resilient means for applying tension to sad cable whereby to urge said cable into frictional engagement with said pulley wheel.

14. Karate exercise apparatus according to claim 13, said cable having opposite ends extending away from diametrically opposed peripheral edges of said pulley wheel, means for connecting said opposite ends of said cable to said base housing, and said resilient means defined by elongated spring members connected to said free end portions between said base housing and said pulley wheel and extending along imaginary radial lines away from said pulley wheel.

15. Karate exercise apparatus according to claim 14, including dampener means interconnecting said resilient means whereby to dampen oscillations of said torsion shaft when said resilient means returns said torsion shaft to said neutral position.

16. Karate exercise apparatus according to claim 15, including means for adjustably connecting said dampener means to said base housing to adjust the amount of dampening force applied by said dampener means to said resilient means.

* * * * *